US006722142B1

(12) United States Patent
Pagel

(10) Patent No.: US 6,722,142 B1
(45) Date of Patent: Apr. 20, 2004

(54) REFRIGERATED ENCLOSURE

(75) Inventor: Jeffrey J. Pagel, Stoughton, WI (US)

(73) Assignee: Sub-Zero Freezer Company, Inc., Madison, WI (US)

( * ) Notice: Subject to any disclaimer, the term of this patent is extended or adjusted under 35 U.S.C. 154(b) by 0 days.

(21) Appl. No.: 10/361,053

(22) Filed: Feb. 7, 2003

(51) Int. Cl.[7] ..... F25B 49/00; A47F 3/04
(52) U.S. Cl. ..... 62/131; 62/248; 62/186
(58) Field of Search ..... 62/131, 248, 186, 62/176.1

(56) References Cited

U.S. PATENT DOCUMENTS

| | | | | |
|---|---|---|---|---|
| 3,307,373 | A | 3/1967 | Booth | 62/248 |
| 4,009,586 | A | 3/1977 | Skvarenina | 62/80 |
| 4,035,608 | A | 7/1977 | Stromquist et al. | 219/218 |
| 4,072,486 | A | 2/1978 | Joseph | 62/131 |
| 4,145,893 | A | 3/1979 | Vogel | 62/151 |
| 4,325,227 | A | 4/1982 | Ibrahim | 62/248 |
| 4,375,155 | A | 3/1983 | Rosanio et al. | 62/256 |
| 4,478,047 | A | 10/1984 | Ibrahim | 62/82 |
| 4,496,201 | A | 1/1985 | Allgeyer | 312/296 |
| 4,528,820 | A | 7/1985 | Jonasson | 62/80 |
| 4,741,172 | A | 5/1988 | Aoki | 62/248 |
| 4,750,335 | A | 6/1988 | Wallace et al. | 62/248 |
| 4,782,666 | A | 11/1988 | Costan | 62/248 |
| 4,827,729 | A | 5/1989 | Groth et al. | 62/80 |
| 4,862,701 | A | 9/1989 | Small et al. | 62/150 |
| 4,881,315 | A | 11/1989 | Powell et al. | 62/277 X |
| 4,977,754 | A | 12/1990 | Upton et al. | 62/248 |
| 5,058,393 | A | 10/1991 | Callon et al. | 62/255 |
| 5,329,736 | A | 7/1994 | Sodervall | 62/255 X |
| 5,374,116 | A | 12/1994 | Borgen et al. | 62/250 |
| 5,428,968 | A | 7/1995 | Tetsukawa et al. | 62/248 |
| 5,449,885 | A | 9/1995 | Vandecastele | 62/248 X |
| 5,589,958 | A | 12/1996 | Lieb | 349/16 |
| 5,715,694 | A | 2/1998 | Yakumaru et al. | 62/210 |
| 5,725,294 | A | 3/1998 | Froelicher | 62/453 X |
| 5,729,997 | A | 3/1998 | Witsoe | 62/150 |
| 5,778,689 | A | 7/1998 | Beatenbough | 62/150 |
| 5,852,284 | A | 12/1998 | Teder et al. | 219/522 |
| 5,899,078 | A | 5/1999 | Mager | 62/80 |
| 6,058,722 | A * | 5/2000 | Choi | 62/153 |
| 6,151,904 | A | 11/2000 | Jin | 62/248 |
| 6,155,060 | A | 12/2000 | Parkman | 62/94 |
| 6,247,773 | B1 | 6/2001 | Harigai et al. | 312/405 |
| 6,301,913 | B1 | 10/2001 | Schulak et al. | 62/248 |
| 6,324,853 | B1 | 12/2001 | Kelly et al. | 62/80 |
| 6,350,000 | B1 | 2/2002 | Van Benthem et al. | 312/236 |
| 6,378,324 | B1 | 4/2002 | Percy et al. | 62/448 |
| 6,470,696 | B1 | 10/2002 | Palfy et al. | 62/140 |
| 6,647,734 | B2 * | 11/2003 | Cho et al. | 62/131 |

* cited by examiner

*Primary Examiner*—William Wayner
(74) *Attorney, Agent, or Firm*—Foley & Lardner

(57) ABSTRACT

A refrigerated enclosure, for example a household refrigerator, having improved appearance and functionality by including a view panel, for example a glass window in a door of the refrigerated enclosure, a door switch, a controller, and an intermittent fan for removing moisture that condenses on the view panel. The refrigerated enclosure may also include interchangeable components, for example exterior panels, for coordinating or matching the appearance of the refrigerated enclosure to the surroundings into which the refrigerated enclosure is placed.

44 Claims, 4 Drawing Sheets

REFRIGERATED ENCLOSURE

FIELD OF THE INVENTION

This invention relates generally to a refrigerated enclosure, and more specifically to a refrigerated enclosure having a view panel and an intermittent fan for removing moisture that condenses on the view panel.

BACKGROUND OF THE INVENTION

Refrigerated enclosures (e.g., refrigerator, freezer, cooler, refrigerated display case, etc.) are used in residential settings, and also in commercial settings, for example in stores and restaurants. Commercial refrigerated enclosures often include a view panel, which may be located in a door, for viewing the contents of the refrigerated enclosure. This feature can conserve energy by minimizing the period of time the door is opened during product retrieval, selection, or location. This feature can also speed up product selection or location and, in the event the desired product is not present in the refrigerated enclosure, avoid the need to open the refrigerated enclosure at all during product selection or location.

A long standing problem with commercial refrigerators with view panels is condensation on the view panel. Condensation can occur on either the interior surface or the exterior surface of the view panel, when either of those surfaces are at a temperature below the dew point temperature of the air these surfaces are exposed to. However, condensation on the interior surface of the view panel is more commonly a problem, as explained below.

Under normal operation the air temperature inside the refrigerated enclosure is much lower than the outside air temperature. The interior surface of the view panel is exposed to the cooler inside air, while the exterior surface of the view panel is exposed to the warmer outside air. Although the view panel itself provides at least some insulation between the interior and exterior surfaces of the view panel, there will always be some heat transfer through the view panel. Thus, in normal operation the outside air is warmer than the exterior surface of the view panel, the exterior surface of the view panel is warmer the interior surface of the view panel, and the interior surface of the view panel is warmer than the air inside the refrigerated enclosure.

The difference between the temperature of the exterior surface of the view panel and the outside air depends on a number of variables, including the insulation value of the view panel itself and the temperature and circulation of the inside and outside air. If the view panel is designed to minimize heat transfer through the view panel itself, for example by using double paned glass or other material having a relatively high insulation value, the exterior surface of the view panel will be only slightly cooler than the exterior air temperature. Thus, by using a view panel with a high insulation value, as long as the exterior air temperature is well above the dew point so that the temperature of the slightly cooler exterior surface is also above the dew point, condensation on the exterior surface of the view panel can be avoided When the door to a refrigerated enclosure remains closed, the interior air is cooled and dehumidified by the refrigeration apparatus, which lowers the dew point of the inside air. Since any view panel material will have at least some heat transfer through the view panel itself, the temperature of the interior surface of the view panel will always be at least slightly warmer than the interior air temperature. Thus, as long as the interior air temperature is above the dew point, the warmer interior surface of the view panel will also be above the dew point, and condensation on the interior surface of the view panel will be avoided.

In summary, if the view panel is designed to minimize heat transfer through the view panel itself and the interior and exterior air are not near their respective dew points, condensation on the interior and exterior surfaces of the view panel is usually not a problem as long as the door to the refrigerated enclosure remains closed.

However, when a refrigerated enclosure is opened, warm outside air is brought into the refrigerated enclosure. Since this warm outside air has not yet been cooled and dehumidified by the refrigeration apparatus, the dew point of the warm outside air may be substantially higher than the temperature of the interior surface of the view panel. When this warm outside air comes into contact with the interior surface of the view panel, condensation is likely to form. Condensation can be especially likely when the view panel is located in the door such that the warm outside air flows directly onto the much cooler view panel. Condensation on the view panel is undesirable since it destroys the utility of the view panel and detracts from the visual appearance of the refrigerated enclosure.

The problem of condensation on the interior surface of the view panel when the refrigerated enclosure is opened can be exacerbated by the use of view panel materials having a high insulation value. A view panel having a higher insulation value will keep the exterior surface of the view panel warmer, but it will also keep the interior surface of the view panel cooler. Especially if the interior air is already close to the dew point when outside humid air is introduced by opening the refrigerated enclosure, condensation on the cool interior surface of the view panel can be even more likely when view panels having a high insulation value are used.

It is known to reduce or remove condensation from a commercial refrigerated enclosure generally by applying heat to areas likely to be affected by condensation, such as door jambs and the interior and exterior surfaces of view panels. For example, an electric heater has been positioned adjacent the inside of the front face, or inside the doors, of a refrigerated cabinet, a hot gas loop has been positioned inside the front face of a refrigerated cabinet, and electrical heating elements have been concealed within the outer edges of the door or within the door frame of a refrigerated display case.

However, any heating element consumes power, and the introduction of a heating element on or near a refrigerated enclosure may be especially inefficient since heat produced by such a heating element can end up in the refrigerated enclosure, from which it must be subsequently removed, consuming additional power. It is also known to reduce or remove condensation from refrigerated enclosures used in commercial environments by operating a fan directed at clear windows. However, in commercial refrigerated enclosures such fans are run continuously during operation, consuming power and producing noise.

It is also generally known to provide a refrigerated enclosure in a residential or household environment, for example the common household refrigerator. Household refrigerators have evolved considerably over the years in response to evolving consumer preferences as well as more stringent requirements for energy efficiency. Because of differences in the commercial and residential settings, the design of a household refrigerator may differ in some respects from those of a commercial refrigerated enclosure. Most household refrigerators do not include a window or view panel on the door.

Nonetheless, for many of the same reasons that a view panel is desirable in a commercial refrigerated enclosure, it would also be desirable and advantageous to provide a household refrigerator with a view panel, for example a glass window in the door. As in a commercial setting, a view allows the contents of a household refrigerator to be viewed, which can reduce time spent perusing or searching the interior while the door is open and thereby reduce energy consumption. Further, especially in the high end consumer market, the ornamental appearance of a household refrigerator can be enhanced by a glass window in the door.

As in the commercial setting, household refrigerators with a view panel can also encounter condensation problems. However, approaches which may be adequate in the commercial environment have a number of drawbacks for household refrigerators.

For example, heating elements require substantial additional material and labor to install, increasing manufacturing costs. Heating elements consume power, increasing the cost of operation. Heating elements also introduce additional components which may fail, increasing the likelihood that repairs will be needed. In the event that repairs are needed, these heating elements may not be readily accessible after the manufacture of the refrigerator is completed, such that any necessary repairs may be both difficult and costly.

Similarly, although a continuously operating fan may be acceptable in a commercial environment, this approach also has drawbacks when applied in a household refrigerator. Stringent government regulation of energy consumption of household refrigerators may conflict with a fan that runs continuously. A fan that runs continuously may also generate unacceptable sound levels, and a fan that runs continuously may wear out or fail sooner.

Further, when a household refrigerator incorporates a view panel, the requirements for reduced energy consumption which apply to household appliances can also motivate, if not require, the use of a view panel material having a high insulation value. As explained above, the use of a view panel material having a high insulation value can exacerbate the problem of condensation on the interior surface of the view panel.

Thus, although techniques for avoiding or reducing condensation on view panels used in commercial refrigeration enclosures may exist, these approaches have drawbacks when applied in the residential or household environment.

SUMMARY OF THE INVENTION

A refrigerated enclosure according to the present invention includes enclosure walls defining a refrigerated space, a view panel, a door, a door switch indicating whether the door is open or closed, a fan, and a controller, wherein the controller operates the fan to reduce or remove moisture that accumulates on the view panel, for example using an intermittent fan. In a preferred embodiment according to the invention, the controller turns the fan on for about five minutes after the door has been opened and then closed.

According to one aspect of the invention, a refrigerated enclosure may include enclosure walls defining an interior refrigerated space, a view panel providing visual access to at least a portion of the interior refrigerated space of the refrigerated enclosure, a door, a door switch adapted to detect whether the door is open or closed and to transmit a signal indicating whether the door is open or closed, a controller adapted to receive the signal indicating whether the door is open or closed, a fan adapted to blow air onto at least a portion of the view panel and adapted to be turned on and turned off by the controller; and a cooling apparatus adapted to produce cooling within the refrigerated and adapted to be turned on and turned off by the controller, wherein the controller is further adapted to turn the fan on after the door switch transmits a signal indicating the door is open and the controller is further adapted to turn the fan off after a delay period of time has elapsed after the door switch transmits a signal indicating the door is closed.

According to another aspect of the invention, a refrigerated enclosure includes enclosure walls defining an interior refrigerated space, a view panel, a door, a door switch indicating whether the door is open or closed, a fan, and a controller, wherein the controller turns the fan on after the door has been opened and then closed, and the controller subsequently turns the fan off after a delay period of time.

According to another aspect of the invention, a refrigerated enclosure may include one or more interchangeable panels, interchangeable grilles, interchangeable handles, or interchangeable trim pieces, for example so that the appearance of the refrigerated enclosure may be coordinated or matched to the surroundings into which the refrigerated enclosure is placed.

The present invention further relates to various features (individually, collectively, or in various subcombinations) shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Further objects, features, and advantages of the invention will be apparent from the following detailed description when taken in conjunction with the accompanying drawings.

DETAILED DESCRIPTION OF THE INVENTION

Figure 1:
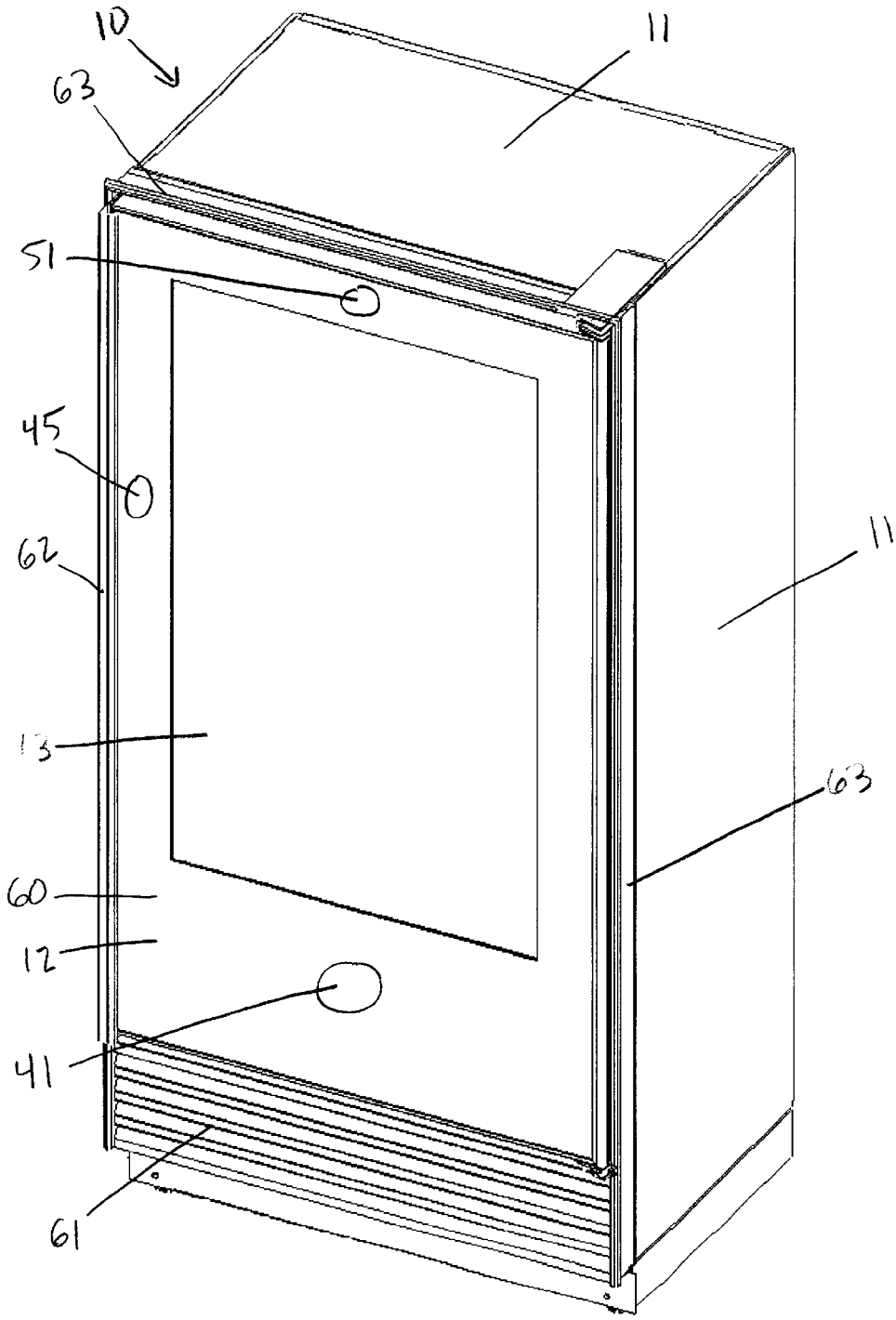
FIG. 1 is a front perspective view of a preferred embodiment of a refrigerated enclosure according to the invention.
Figure 2:
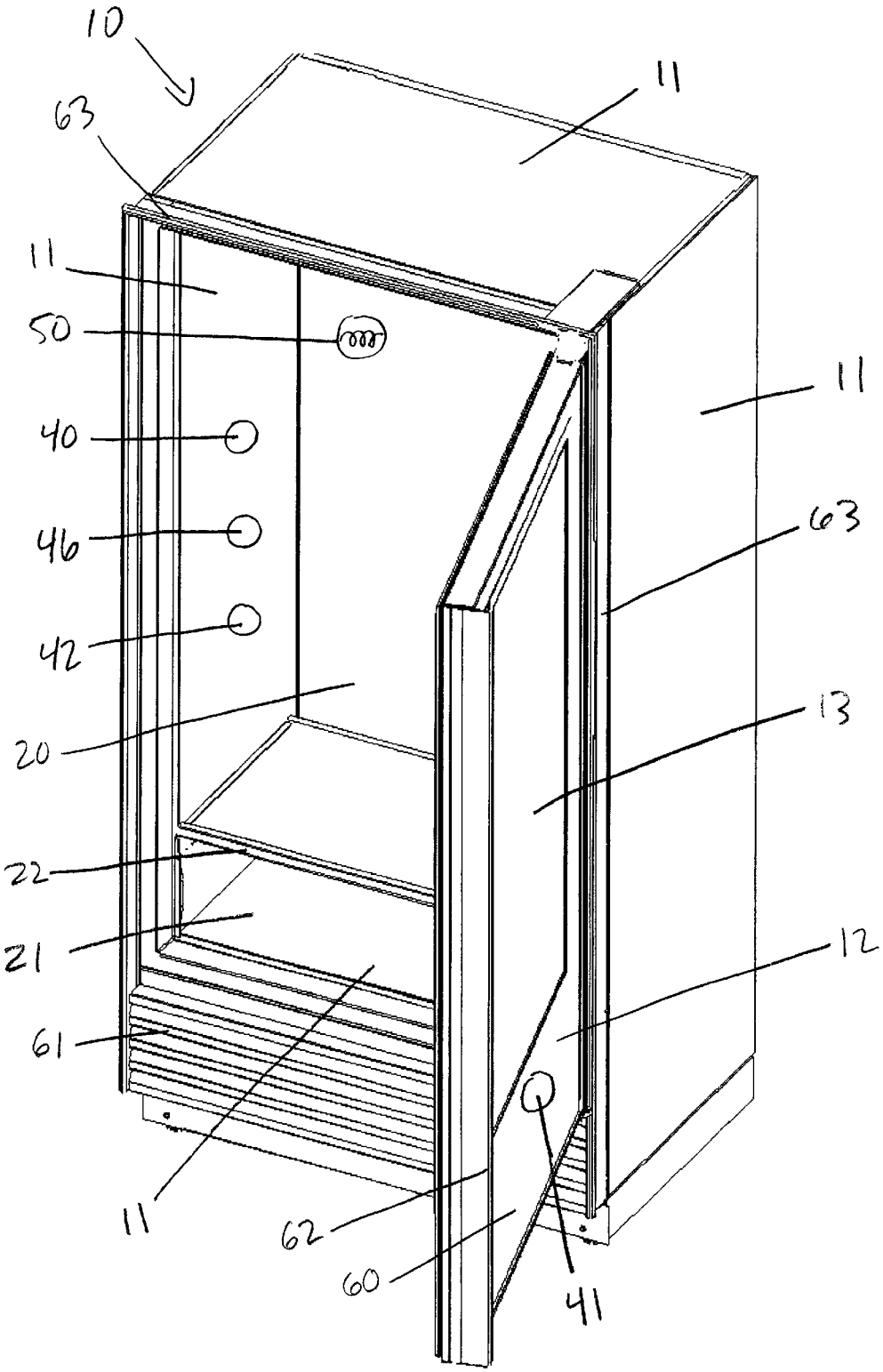
FIG. 2 is a front perspective view of the refrigerated enclosure of FIG. 1 with the door open.
Figure 3:
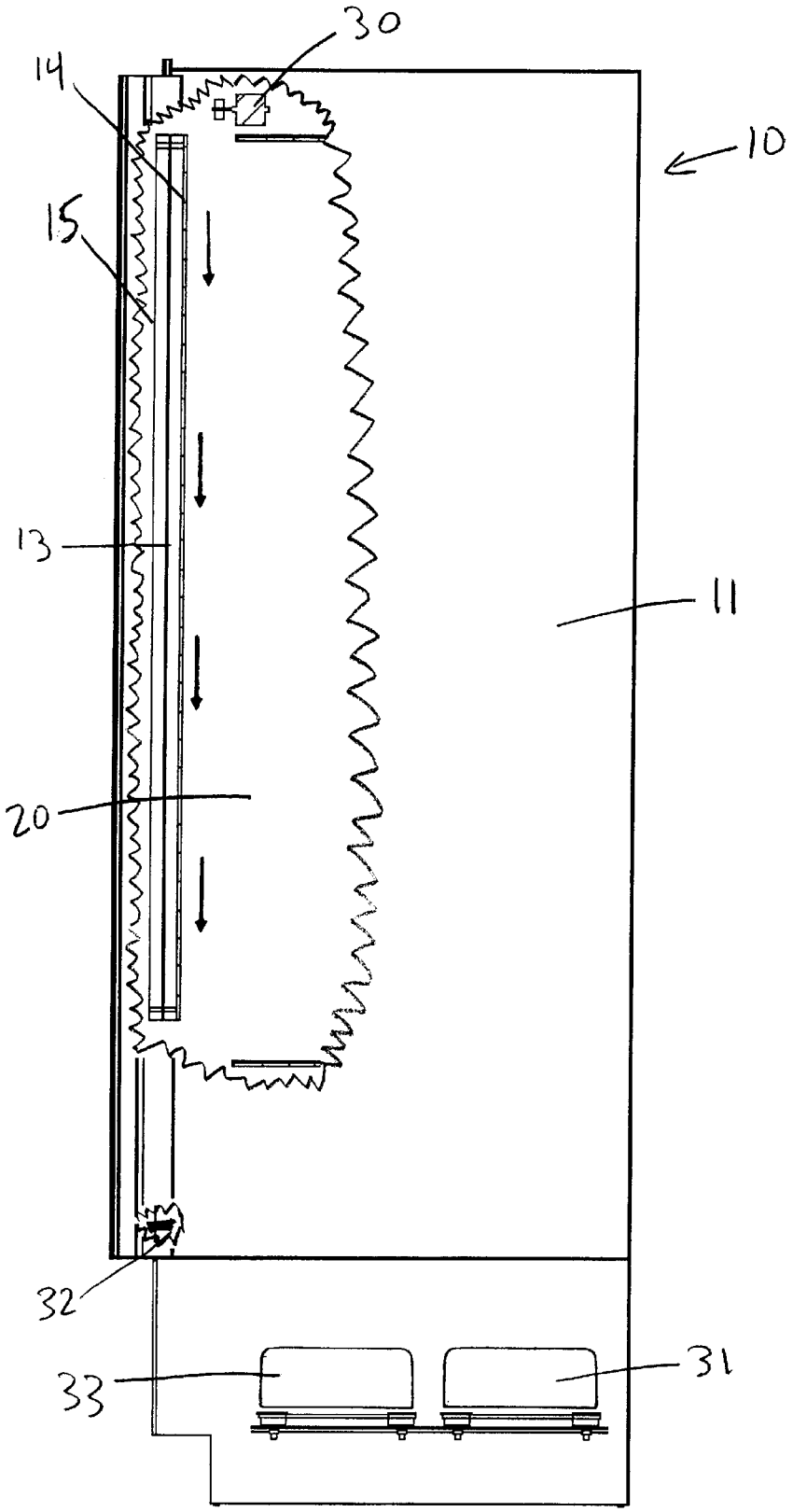
FIG. 3 is a side view of the refrigerated enclosure of FIG. 1 with sections of the housing removed to show internal components.
Figure 4:
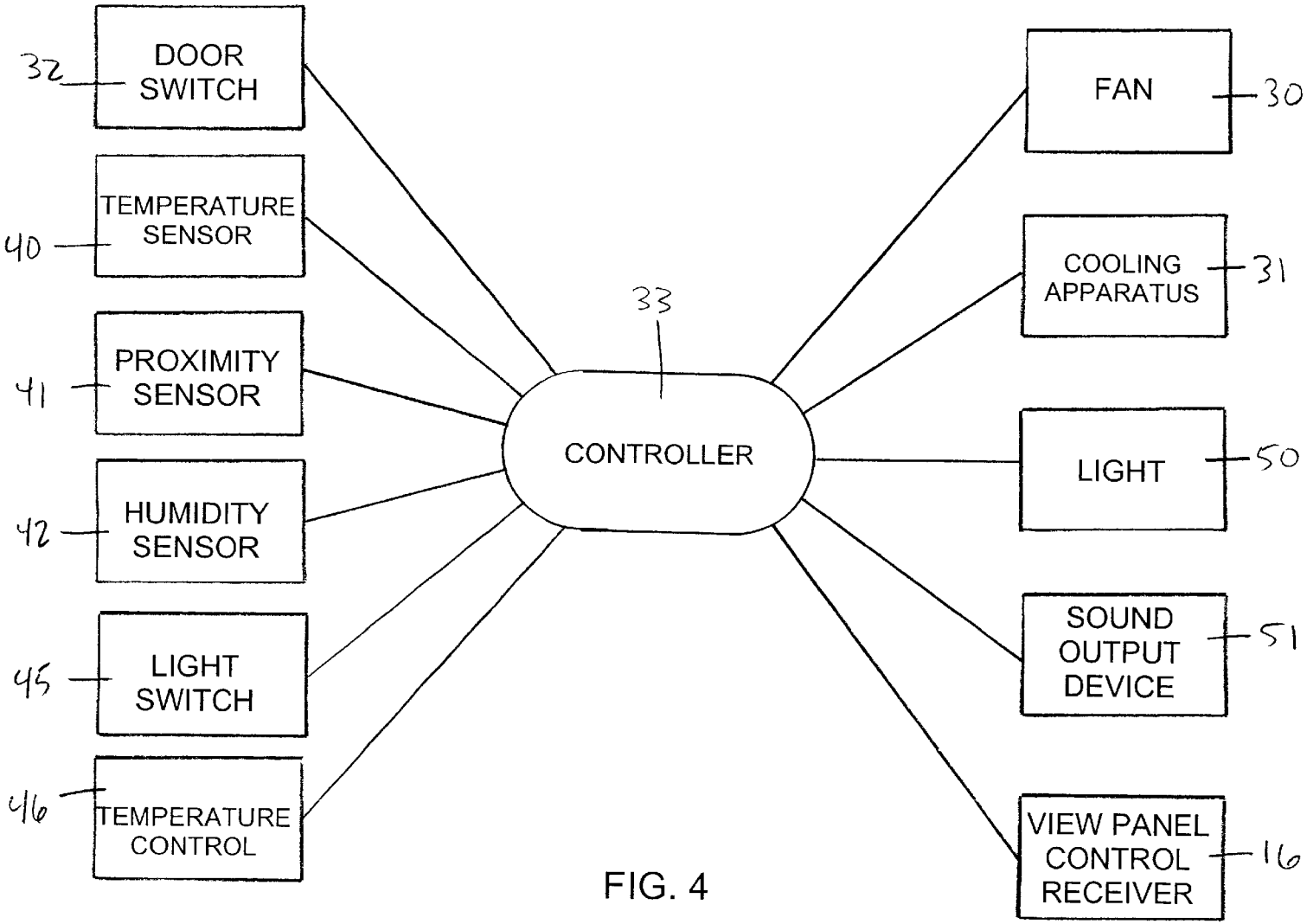
FIG. 4 is a block diagram of the controller and related components of the refrigerated enclosure of FIG. 1.

Referring to the drawings, FIGS. 1–3 show a preferred embodiment of a refrigerated enclosure according to the invention indicated generally at 10. The refrigerated enclosure 10 includes one or more enclosure walls 11, at least one door 12, and at least one view panel 13.

The view panel 13 is preferably incorporated into the door 12, but this is not necessary, and the view panel 13 may be incorporated into portions of an enclosure wall 11. The view panel has an interior surface 14 and an exterior surface 15. The view panel 13 is preferably made of a material configured to allow transmittance of a least a portion of visible light, for example so that a person standing outside of refrigerated enclosure 10 can view its contents. The material from which view panel 13 is made is also preferably resistant to marring, scratching, hazing, and the like.

The view panel 13 is preferably comprised of multiple panes of glass forming a structure having a relatively high insulation value, although this is not required. The view panel 13 may also be comprised of any of a variety of other clear materials providing the desired optical characteristics, including polymethylmethacrylate ("PMMA" or "acrylic"), Plexiglass® (Rohm & Hass), or Lucite® sheets (commercially available from E.I. DuPont de Nemours and Company of Wilmington, Del. ), clear polyvinyl chloride ("PVC"), other plastics or glasses, or mixtures or combinations thereof.

Although in a preferred embodiment view panel 13 is fully transparent, this is not required, and view panel 13 may also comprise material which is translucent, for example smoked or tinted glass and the like. View panel 13 may also comprise glass which is at least partially mirrored, for example one-way mirrored glass and the like. View panel 13 may also comprise material having controllable, selectable, or variable transparency, for example electrochromic glass, suspended particle device glass, polymer dispersed liquid crystal glass, or liquid crystal glass and the like, and the refrigerated enclosure 10 may include a view panel control receiver 16 that controls, selects, or varies the transparency of the view panel 13 and is adapted to receive a view panel control signal from a controller.

As is known in the art, the interior of the refrigerated enclosure 10 preferably includes an upper food storage compartment 20 and a lower food storage compartment 21, separated by a divider 22, although other arrangements and numbers of compartments are possible. In a preferred embodiment, the upper food storage compartment 20 may be used for foods, such as milk, juice, or fresh vegetables and produce, which require refrigerated temperatures which are above the freezing point of water, and the lower food storage compartment 21 may be used for foods, such as ice cream or frozen vegetables, which are below the freezing point of water.

As is known in the art, the one or more enclosure walls 11 and door 12 of the refrigerated enclosure 10 preferably include thermal insulation material, for example foam insulation, between an outer shell and an inner liner. The outer shell and the inner liner of the enclosure walls 11 and door 12 may be formed, for example, of plastic or by bending and welding a sheet of a suitable metal, such as steel.

As shown in FIG. 3, the refrigerated enclosure 10 includes at least one fan 30, at least one cooling apparatus 31, and at least one door switch 32 adapted to produce a door switch signal indicating whether the door is open or closed. The refrigerated enclosure 10 also includes at least one controller 33 adapted to receive the door switch signal from the door switch 32 and adapted to control the fan 30.

The fan 30 may be any device or combination of devices configured to circulate air as directed by the controller 33, for example the fan 30 may be an electric fan that can be turned on and off by the controller 33. The fan 30 may be a variable speed device, such that the magnitude of the air flow produced by the fan 30 may be modulated by the controller 33, at several discrete levels or smoothly adjustable across a range of levels. The fan 30 may be the only air flow device in the refrigerated enclosure 10, or the refrigerated enclosure may include other air flow devices, in addition to the fan 30. In a preferred embodiment, the fan 30 comprises a high efficiency axial fan, for example of the type made by Panasonic Industrial Company of Oita, Japan.

The fan 30 is adapted to circulate air across at least a portion of the interior surface of the view panel 13, for example by being positioned directly adjacent to the interior surface 14 of the view panel 13 so that air is blown by the fan 30 directly onto the interior surface 14 of the view panel 13. Portions of the fan 30 may also be positioned at locations which are not adjacent to the interior surface 14 of the view panel 13, in which case the fan 30 may comprise ducting that directs air flow to blow onto the interior surface 14 of the view panel 13. The fan 30 may be adapted to circulate air within the food storage compartments, but this is not required.

The cooling apparatus 31 may be any device or combination of devices configured to produce cooling within the refrigerated enclosure as directed by the controller 33. For example, the cooling apparatus 31 may include one or more compressors, one or more heat exchangers, and at least one gas used as a working substance, and thereby produce cooling by transferring heat out of the refrigerated enclosure, although this is not required and other cooling devices or combinations of devices may be used.

The controller 33 may be any device or combination of devices adapted to receive the door switch signal from the door switch 32 and to control the fan 30. The controller 33 preferably includes at least one microprocessor or microcontroller, memory, input circuitry adapted to receive input signals such as the door switch signal, and output circuitry adapted to produce output signals such as a fan control signal to the fan 30, although this is not required and other devices may be used.

For example, the controller 33 may be a time delayed relay circuit which supplies power to the fan 30 when the door switch 32 indicates that the door is open, and removes power from the fan 30 following a fixed period of time after the door switch 32 indicates that the door is closed. Alternatively, the controller 33 may be, for example, a proportional integral (PI) type device, a proportional integral derivative (PID) type device, or digital logic along with analog-to-digital and digital-to-analog converters, or the like. In a preferred embodiment, the controller 33 comprises a microprocessor based control circuit of the type manufactured by Invensys Appliance Controls of Holland, Michigan.

The refrigerated enclosure 10 may include additional features, although this is not required. The refrigerated enclosure 10 may include one or more temperature sensors 40 adapted to output a temperature signal, and the controller 33 may be adapted to receive the temperature signal. In a preferred embodiment, the temperature sensor 40 is a thermistor type sensor of the type sold by Therm-O-Disc of Mansfield, Ohio.

The refrigerated enclosure 10 may include one or more proximity sensors 41 adapted to output a presence signal indicating that a person is near the refrigerated enclosure, and the controller 33 may be adapted to receive the presence signal. The refrigerated enclosure 10 may include one or more humidity sensors 42 adapted to output a humidity signal, and the controller 33 may be adapted to receive the humidity signal.

The refrigerated enclosure 10 may include one or more light switches 45 adapted to output light switch state information, and the controller 33 may be adapted to receive the light switch state information. The one or more light switches 45 may be located on exterior of refrigerated enclosure for operation without opening the refrigerated enclosure. The one or more light switches 45 may be adapted to receive manual control input from a person, although this is not required, and the control input received by the light switch may come from another source, for example from a home automation system, a timer, or the proximity sensor.

The refrigerated enclosure 10 may include one or more temperature controls 46 adapted to output a desired temperature setpoint signal, and the controller 33 may be adapted to receive the desired temperature setpoint signal. The one or more temperature controls 46 may be adapted to receive manual control input from a person, although this is not required, and the control input received by the temperature control may come from another source, for example a home automation system or a timer.

In a preferred embodiment, the temperature control 46 is adapted to receive manual control input from a person using two control buttons labeled "Warmer" and "Cooler," and the temperature control 46 comprises a temperature display which normally displays the actual temperature within the refrigerated enclosure, but which displays the temperature setpoint while the temperature control 46 is receiving manual control input.

The refrigerated enclosure may include one or more lights 50 for illuminating the upper food storage area 20, the lower food storage area 21, the exterior of the refrigerated enclosure, or any combination of these area. The refrigerated enclosure may include one or more sound output devices 51 for producing sounds capable of being heard by a person, for example a buzzer, bell sound, or spoken message. The spoken message, for example "please close the door," may be provided in multiple languages, although this is not required.

The controller 33 may be further adapted to control one or more of the fan 30, the cooling apparatus 31, the one or more lights 50, the one or more sound output devices 51, or the view panel control receiver 16 using one or more of the signals or information produced by the door switch 32, the temperature sensor 40, the proximity sensor 41, the humidity sensor 42, the light switch 45, and the temperature control 46.

According to an exemplary embodiment, after the controller receives a door switch signal from the door switch 32 indicating the door 12 has been opened and closed, the controller 33 turns on fan 30 for a period of time, and then turns off fan 30. For example, after door 12 has been opened and closed, controller 33 may activate fan 30 for one to fifteen minutes. In a particularly preferred embodiment, after door 12 has been opened and closed, controller 33 turns on fan 30 for about five minutes, then controller 33 turns fan 30 off.

A refrigerated enclosure according to the invention may include various interchangeable components configured to provide the consumer and retailer options in purchasing, configuring, reconfiguring, presenting, and customizing the refrigerated enclosure, although this is not necessary. For example, the refrigerated enclosure may include one or more interchangeable panels 60, one or more interchangeable grilles 61, one or more interchangeable handles 62, or one or more interchangeable trim pieces 63, which may be releasably coupled or incorporated into the cabinet 11 or the door 12, although this is not necessary. The interchangeable components, for example the interchangeable panels 60, may be provided in a variety of materials and appearances, for example wood veneer, painted metal, stainless steel, black lacquer, various colors, and the like, so that the appearance of the refrigerated enclosure may be coordinated or matched to the surroundings into which the refrigerated enclosure is placed.

It is also important to note that the construction and arrangement of the elements of the intermittent fan for glass door refrigerator as shown in the preferred and other exemplary embodiments are illustrative only.

Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, while the components of the disclosed embodiments will be illustrated as an intermittent fan for a refrigerated enclosure, the features of the disclosed embodiments have a much wider applicability. For example, the intermittent fan design is adaptable for other storage units, bins, containers, and other office, home, or industrial, educational environments that employ a storage space with a door or panel susceptible to condensation.

Accordingly, the particular materials used to construct the exemplary embodiments are also illustrative. For example, as previously discussed, although the view panel preferably comprises a glass panel, a variety of other materials can be used. All such modifications, to materials or otherwise, are intended to be included within the scope of the present invention as defined in the appended claims.

The order or sequence of any process or method steps may be varied or re-sequenced according to alternative embodiments. Other substitutions, modifications, changes and/or omissions may be made in the design, operating conditions and arrangement of the preferred and other exemplary embodiments without departing from the spirit of the present invention as expressed in the appended claims.

It is understood that the invention is not confined to the embodiments set forth herein as illustrative, but embraces all such forms thereof that come within the scope of the following claims.

What is claimed is:

1. A refrigerated enclosure comprising:

one or more enclosure walls defining an interior refrigerated space;

a view panel;

a door;

a door switch adapted to detect whether the door is open or closed and to transmit a door switch signal indicating whether the door is open or closed;

a controller adapted to receive the door switch signal indicating whether the door is open or closed; and a fan adapted to blow air onto at least a portion of the view panel and adapted to be turned on and turned off by the controller;

wherein the controller is further adapted to turn the fan on after the door switch signal indicates the door is open, the controller is further adapted to have a delay period of time, and the controller is further adapted to turn the fan off after the delay period of time has elapsed after the door switch signal indicates the door is closed.

2. The refrigerated enclosure of claim 1 wherein the delay period of time is at least 30 seconds.

3. The refrigerated enclosure of claim 1 further comprising:

a cooling apparatus adapted to produce cooling within the refrigerated enclosure and adapted to be turned on and turned off by the controller;

wherein the controller is further adapted to turn the cooling apparatus off during at least a portion of the delay period of time.

4. The refrigerated enclosure of claim 1 wherein the delay period of time is about five minutes.

5. The refrigerated enclosure of claim 4 further comprising:

a cooling apparatus adapted to produce cooling within the refrigerated and adapted to be turned on and turned off by the controller;

wherein the controller is further adapted to turn the cooling apparatus off during at least a portion of the delay period of time.

6. The refrigerated enclosure of claim 1 further comprising one or more interchangeable components releasably coupled to the door, whereby the appearance of the refrigerated enclosure may be altered.

7. The refrigerated enclosure of claim 1 further comprising:

at least one humidity sensor adapted to measure at least one humidity value and to transmit at least one humidity signal;

wherein the controller is further adapted to receive the at least one humidity signal and to calculate the delay period of time using the at least one humidity signal.

8. The refrigerated enclosure of claim 7 further comprising:

at least one temperature sensor adapted to measure at least one temperature value and to transmit at least one temperature signal;

wherein the controller is further adapted to receive the at least one temperature signal and to calculate the delay period of time using the at least one temperature signal.

9. The refrigerated enclosure of claim 1 further comprising:

at least one temperature sensor adapted to measure at least one temperature value and to transmit at least one temperature signal;

wherein the controller is further adapted to receive the at least one temperature signal and to calculate the delay period of time using the at least one temperature signal.

10. The refrigerated enclosure of claim 1 further comprising:

at least one proximity sensor adapted to detect whether a person is present in the vicinity of the refrigerated enclosure and to transmit at least one presence signal indicating whether a person is present in the vicinity of the refrigerated enclosure.

11. The refrigerated enclosure of claim 10 further comprising at least one light adapted to be turned on and off by the controller;

wherein the controller is further adapted to receive the at least one presence signal and to turn on the light when the presence signal indicates a person is present in the vicinity of the refrigerated enclosure.

12. The refrigerated enclosure of claim 10 further comprising at least one light adapted to be turned on and off by the controller;

wherein the controller is further adapted to receive the at least one presence signal and to turn off the light when the presence signal indicates a person is not present in the vicinity of the refrigerated enclosure.

13. The refrigerated enclosure of claim 10 further comprising:

at least one light adapted to be turned on and off by the controller; and at least one light switch adapted to receive manual control from a person and to produce at least one light switch signal indicating whether light is to be produced;

wherein the controller is further adapted to receive the at least one presence signal and to receive the at least one light switch signal and to turn on the light when both the presence signal indicates a person is present in the vicinity of the refrigerated enclosure and the light switch signal indicates light is to be produced.

14. The refrigerated enclosure of claim 10 further comprising:

at least one light adapted to be turned on and off by the controller; and at least one light switch adapted to receive manual control from a person and to produce at least one light switch signal indicating whether light is to be produced;

wherein the controller is further adapted to receive the at least one presence signal and to receive the at least one light switch signal and to turn on the light when either the presence signal indicates a person is present in the vicinity of the refrigerated enclosure or the light switch signal indicates light is to be produced.

15. The refrigerated enclosure of claim 10 further comprising at least one view panel control receiver adapted to receive a view panel control signal from the controller;

wherein the view panel is adapted to have a transparency controllable by the view panel control receiver, and wherein the controller is further adapted to receive the at least one presence signal and to send a view panel control signal for increasing the transparency of the view panel when the presence signal indicates a person is present in the vicinity of the refrigerated enclosure.

16. The refrigerated enclosure of claim 10 further comprising at least one view panel control receiver adapted to receive a view panel control signal from the controller;

wherein the view panel is adapted to have a transparency controllable by the view panel control receiver, and wherein the controller is further adapted to receive the at least one presence signal and to send a view panel control signal for decreasing the transparency of the view panel when the presence signal indicates a person is not present in the vicinity of the refrigerated enclosure.

17. The refrigerated enclosure of claim 1 further comprising at least one sound output device adapted to be controlled by the controller and to produce at least one sound.

18. The refrigerated enclosure of claim 17 wherein the sound produced by the sound output device includes at least one word.

19. The refrigerated enclosure of claim 17 wherein the controller is further adapted to control the sound output device to produce a sound for at least a portion of any period of time in which the door signal indicates the door is open.

20. The refrigerated enclosure of claim 19 wherein the sound produced by the sound output device includes at least one word.

21. The refrigerated enclosure of claim 17 wherein the controller is further adapted to control the sound output device to produce a sound for at least a portion of any period of time exceeding 30 seconds in which the door signal indicates the door is open.

22. The refrigerated enclosure of claim 21 wherein the sound produced by the sound output device includes at least one word.

23. A method of removing condensation from a view panel in a refrigerated enclosure having a door, comprising:

providing a door switch adapted to detect whether the door is open or closed and adapted to transmit a door signal indicating whether the door is open or closed;

providing a controller;

providing a fan adapted to be turned on and turned off by the controller and adapted to blow air onto at least a portion of the view panel;

the controller receiving the door signal;

the controller turning on the fan after the door signal indicates the door is open; and the controller turning off the fan after a delay period of time has elapsed after the door signal indicates the door is closed.

24. The method of claim 23 wherein the delay period of time is at least 30 seconds.

25. The method of claim 23 further comprising:

providing a cooling apparatus adapted to produce cooling within the refrigerated enclosure and adapted to be turned on and turned off by the controller; and the controller turning off the cooling apparatus during at least a portion of the delay period of time.

26. The method claim 23 wherein the delay period of time is about five minutes.

27. The method of claim 26 further comprising:

providing a cooling apparatus adapted to produce cooling within the refrigerated enclosure and adapted to be turned on and turned off by the controller; and the controller turning off the cooling apparatus during at least a portion of the delay period of time.

28. The method of claim 23 further comprising providing one or more interchangeable components releasably coupled to the door, whereby the appearance of the refrigerated enclosure may be altered.

29. The method of claim 23 further comprising:

providing at least one sensor adapted to measure at least one humidity value and adapted to transmit at least one humidity signal;

the controller receiving the at least one humidity signal; and the controller calculating the delay period of time using the at least one humidity signal.

30. The method of claim 29 further comprising:

providing at least one sensor adapted to measure at least one temperature value and adapted to transmit at least one temperature signal;

the controller receiving the at least one temperature signal; and the controller calculating the delay period of time using the at least one temperature signal.

31. The method of claim 23 further comprising:

providing at least one sensor adapted to measure at least one temperature value and adapted to transmit at least one temperature signal;

the controller receiving the at least one temperature signal; and the controller calculating the delay period of time using the at least one temperature signal.

32. The method of claim 23 further comprising providing at least one proximity sensor adapted to detect whether a person is present in the vicinity of the refrigerated enclosure and adapted to transmit at least one presence signal indicating whether a person is present in the vicinity of the refrigerated enclosure.

33. The method of claim 32 further comprising:

providing at least one light adapted to be turned on and off by the controller;

the controller receiving the at least one presence signal; and the controller turning on the light when the presence-signal indicates a person is present in the vicinity of the refrigerated enclosure.

34. The method of claim 32 further comprising:

providing at least one light adapted to be turned on and off by the controller;

the controller receiving the at least one presence signal; and the controller turning off the light when the presence signal indicates a person is not present in the vicinity of the refrigerated enclosure.

35. The method of claim 32 further comprising:

providing at least one view panel control receiver adapted to receive a view panel control signal from the controller;

the controller receiving the at least one presence signal; and the controller sending a view panel control signal to the view panel control receiver for increasing the transparency of the view panel when the presence signal indicates a person is present in the vicinity of the refrigerated enclosure.

36. The method of claim 32 further comprising:

providing at least one view panel control receiver adapted to receive a view panel control signal from the controller;

the controller receiving the at least one presence signal; and the controller sending a view panel control signal to the view panel control receiver for decreasing the transparency of the view panel when the presence signal indicates a person is not present in the vicinity of the refrigerated enclosure.

37. The method of claim 32 further comprising:

providing at least one light adapted to be turned on and off by the controller;

providing at least one light switch adapted to receive manual control from a person and adapted to produce at least one light switch signal indicating whether light is to be produced;

the controller receiving the at least one presence signal;

the controller receiving the at least one light switch signal; and the controller turning on the light when both the presence signal indicates a person is present in the vicinity of the refrigerated enclosure and the light switch signal indicates light is to be produced.

38. The method of claim 32 further comprising:

providing at least one light adapted to be turned on and off by the controller;

providing at least one light switch adapted to receive manual control from a person and to produce at least one light switch signal indicating whether light is to be produced;

the controller receiving the at least one presence signal;

the controller receiving the at least one light switch signal; and the controller turning on the light when either the presence signal indicates a person is present in the vicinity of the refrigerated enclosure or the light switch signal indicates light is to be produced.

39. The method of claim 23 further comprising providing at least one sound output device adapted to be controlled by the controller and to produce at least one sound.

40. The method of claim 39 wherein the sound produced by the sound output device includes at least one word.

41. The method of claim 39 further comprising the controller controlling the sound output device to produce a sound for at least a portion of any period of time in which the door signal indicates the door is open.

42. The method of claim 41 wherein the sound produced by the sound output device includes at least one word.

43. The method of claim 39 further comprising the controller controlling the sound output device to produce a sound for at least a portion of any period of time exceeding 30 seconds in which the door signal indicates the door is open.

44. The method of claim 43 wherein the sound produced by the sound output device includes at least one word.

* * * * *